US012337251B2

(12) United States Patent
Irie

(10) Patent No.: US 12,337,251 B2
(45) Date of Patent: Jun. 24, 2025

(54) MAGNETIC BLOCK TOY, AND TRAVEL COURSE DESIGN DRAWING

(71) Applicant: SUNSMILE CORPORATION, Chiba (JP)

(72) Inventor: Makoto Irie, Chiba (JP)

(73) Assignee: SUNSMILE CORPORATION

( * ) Notice: Subject to any disclaimer, the term of this patent is extended or adjusted under 35 U.S.C. 154(b) by 190 days.

(21) Appl. No.: 17/596,230

(22) PCT Filed: Jan. 4, 2021

(86) PCT No.: PCT/JP2021/001139
§ 371 (c)(1),
(2) Date: Dec. 6, 2021

(87) PCT Pub. No.: WO2021/137303
PCT Pub. Date: Jul. 8, 2021

(65) Prior Publication Data

US 2022/0314135 A1 Oct. 6, 2022

(30) Foreign Application Priority Data

Dec. 30, 2019 (JP) ..... 2019-240233

(51) Int. Cl.
*A63H 18/02* (2006.01)
*A63H 18/12* (2006.01)
(Continued)

(52) U.S. Cl.
CPC ..... *A63H 18/02* (2013.01); *A63H 18/12* (2013.01); *A63H 18/16* (2013.01); *A63H 33/046* (2013.01); *A63H 2018/165* (2013.01)

(58) Field of Classification Search
CPC ..... A63H 18/02; A63H 18/10; A63H 18/16; A63H 2018/165; A63H 33/046; A63H 33/067; A63H 33/106
See application file for complete search history.

(56) References Cited

U.S. PATENT DOCUMENTS 2,690,626 A * 10/1954 Gay ..... A63H 18/10 104/247
3,013,726 A * 12/1961 Orel ..... A63H 18/02 238/10 E (Continued)

FOREIGN PATENT DOCUMENTS

CN 202552418 U * 11/2012
JP 46-19929 Y1 7/1971

(Continued)

OTHER PUBLICATIONS

Translation CN202552418U (Year: 2012).*

*Primary Examiner* — Eugene L Kim
*Assistant Examiner* — Alyssa M Hylinski
(74) *Attorney, Agent, or Firm* — Taro Yaguchi

(57) ABSTRACT

Provided are a versatile track block for creating a track that is capable of securing a more dynamic range of motion for toy mobile object, rather than merely a toy block moved around by hand, and a track plan in which the order of colors or patterns of blocks on the track is recorded as a program. Projecting parts 100, 100 and recessed parts 101, 101 capable of mating with the projecting parts 100 are provided clockwise around the four sides of a block 1. A step part 16 is formed on the upper face of the block 1, and a magnetic plate 2 is set into this step part 16. A track can be created using a plurality of blocks 1 of this sort. In addition, blocks 6 comprising curved magnetic plates 24 and the like can be used to create a three-dimensional track that can be traveled in three dimensions.

12 Claims, 9 Drawing Sheets

(51) Int. Cl.
*A63H 18/16* (2006.01)
*A63H 33/04* (2006.01)

(56) References Cited

U.S. PATENT DOCUMENTS 3,690,031 A * 9/1972 Shinoda ..... A63H 33/04 446/96
4,990,117 A * 2/1991 Yonezawa ..... A63H 18/10 446/444
6,422,151 B2 * 7/2002 Maleika ..... A63H 18/10 104/53
6,688,938 B1 * 2/2004 Lee ..... A63H 17/26 446/129
6,711,865 B2 * 3/2004 Chaudoreille ..... F16B 12/2009 52/592.4
9,086,087 B1 * 7/2015 Sharman ..... F16B 21/04
2008/0064295 A1 * 3/2008 Abrams ..... A63H 18/10 446/444
2010/0304640 A1 * 12/2010 Sofman ..... A63H 18/12 446/456
2012/0125707 A1 * 5/2012 Frank ..... A63H 18/16 180/169
2015/0283472 A1 10/2015 Chantrell et al.
2015/0367247 A1 12/2015 Kosmo
2018/0117481 A1 * 5/2018 Shuck ..... A63H 33/04
2018/0304166 A1 * 10/2018 Tsai ..... A63H 18/08

FOREIGN PATENT DOCUMENTS

JP 1990-19192 U 5/1985
JP H02-19192 Y2 5/1985
JP S6071297 U 5/1985
JP H06-091062 A 4/1994
JP H9-051990 A 2/1997
JP H9-299618 A 11/1997
JP 3052774 U 7/1998
JP 2008-18028 A 1/2008
JP 2011005208 A 1/2011
JP 3215614 U 4/2018
WO WO-2009044390 A2 * 4/2009 ..... A63H 18/02

* cited by examiner

MAGNETIC BLOCK TOY, AND TRAVEL COURSE DESIGN DRAWING

FIELD OF THE INVENTION

The present invention pertains to a toy block having the magnetism necessary to create a track (travel course) for a magnetic wheel that is attracted to magnetic plates on the track as it turns, a toy block that forms a set with the toy block and the magnetic wheel, and a plan programed for the track.

BACKGROUND OF THE INVENTION

In one common form of educational toy, a plurality of blocks comprising projecting parts and recessed parts that detachably fit together can be combined into various forms, and recombined into other forms, by fitting a projecting part on one block into a recessed part in a partner block. A representative example of such toy blocks is LEGO®. Although toy blocks of this sort are effective for fostering creativity, the objects they form, such as buildings and animals, are static, An example of basic toy blocks of this sort that have been modified to function in new ways is a toy block unit comprising a block body comprising a projecting part and a recessed part, a rotating shaft that is rotatably supported by the block body and extends in a linking direction of the block unit, and a rotation-transmitting part that is provided on the end of the rotating shaft and can be linked to another block unit, such as disclosed in JP H06-091062 A. FIG. 7 in JP H06-091062 A depicts a state in which a gear block unit is linked to a motor block unit, and the rotation of a rotating shaft of a motor is transmitted to another block unit.

Another example is the magnetic toy block disclosed in JP 3052774 U, in which a magnet is disposed on a side or rear exterior surface of a three-dimensional object, and magnet-attracting magnetic attachment panels are disposed on the other exterior surfaces thereof. FIG. 17 in JP 3052774 U illustrates a way of playing with such blocks in which a car comprising elongated cylindrical blocks 10 as wheels is assembled from blocks of various shapes.

PRIOR ART DOCUMENTS

Patent Documents

Patent document 1: JP H06-091062 A
Patent document 2: JP 3052774 U

SUMMARY OF THE INVENTION

Problem to be Solved by the Invention

It is true that JP H06-091062 A and JP 3052774 U appear to propose methods of play that transcend static toy blocks to create dynamic combinations. However, in both of the abovementioned documents, the toy blocks are merely moved by hand, and dynamic ranges of motion are not contemplated.

Therefore, the inventor engaged in dedicated research into how to obtain a dynamic range of motion while leaving intact the properties of toy blocks of being combinable into various shapes and re-combinable into other shapes, and effective for fostering creativity. As a result, the inventor hit upon the idea of configuring movable toy blocks such as those described above, or similar toys, to enable movement along a rail, and of forming the rail itself from toy blocks that can be combined into various shapes and recombined into other shapes.

Specifically, a goal of the present invention is to provide versatile track blocks that are not merely toy blocks to be moved by hand, but are capable of providing a more dynamic movement environment for a toy mobile object.

Means for Solving the Problem

The abovementioned goal is achieved through the provision of a magnetic toy block comprising a magnetic element for an attracting magnet, wherein the magnetic element is provided on a surface of a block-shaped element having at least one pair of projecting and recessed parts shaped so as to be capable of being joined together, wherein the magnetic element is capable of being substantially continuous when a plurality of the block-shaped elements is joined together by the projecting and recessed parts. A mobile object provided with a magnet is attracted to the magnetic elements on the track (travel course) while moving over the track thus formed. As a result, the mobile object can be made to travel along a three-dimensionally assembled track even in small spaces. The magnetic element may or may not be flush with the surface of the track. Designs in which the track as a whole is a magnetic element are also possible. There may be one or two pairs of projecting and recessed parts, or three or more pairs if the blocks are rectangular cuboids or the like.

While the feature of a plurality of block-shaped elements being linkable by projecting and recessed parts is nothing new, the block-shaped elements in the present invention comprise magnetic elements on their surfaces, and a track comprising substantially continuous magnetic elements is formed when the block-shaped elements are linked.

The magnetic elements may be of any shape, such as flat, round bars, or wires. Examples of special embodiments of the magnetic element include flat magnetic rubber. While the goal of using a rubber material is to create stronger grip on the wheels or the like when the mobile object is traveling, because the material is also magnetic, the effect of greater magnetic attraction upon the mobile object can be expected. The magnetic elements may be completely continuous along the track or may have slight gaps therebetween, as long as a mobile object provided with a magnet is capable of moving along the track while being attracted to the magnetic elements. The same applies to the individual blocks as well.

The magnetic element may be a magnetic plate, wherein a groove for accommodating the magnetic plate is formed in the surface of the block-shaped element from one edge to another, the magnetic plate is present in the groove, and a raised part that serves as a guide rail for the magnet is formed to the outside of the magnetic plate. In the case of a four-wheeled toy car in which the left and right wheels are magnetic, two grooves, a left groove and a right groove, to which the left and right wheels can attach are formed. In the case of a wheeled mobile object in which the left and right wheels are not magnetic and the mobile object comprises a magnetic wheel in the center, a single central groove to which this wheel can attach is formed. Such considerations are design matters that may be addressed as desired.

The mobile object is attracted to the magnetic plates on the track as it moves; the presence of the step part serving as a guide rail to the outside of the groove in which the magnetic plate has been set keeps the magnet of the mobile object from derailing even if unintended force acts on the magnet of the mobile object in an off-track direction rather than in the track direction. Because the magnet will inherently be attracted to the magnetic plate, designs are also possible in which the magnetic plates serve as guides for the magnet, eliminating the need for a step part; the step part can be considered to reinforce the action of these guides. The step part may have a terrace-like structure or a partition-like structure; this is a design matter that may be addressed as desired.

The magnetic element may be a magnetic plate, wherein a platform that also serves as a guide rail for the magnet is formed on the surface of the block-shaped element from one edge to another, and the magnetic plate is present on the platform. In the case of a toy car, designs are possible in which the magnetic wheel in the center of the mobile object is attracted to the magnetic plate on the platform as the mobile object travels. There may be a single central platform, or two parallel ones.

The magnetic element may be a magnetic plate, wherein the magnetic plate has a straight or curved shape. In the present invention, individual block-shaped elements are linked to form a track with substantially continuous magnetic elements. The track formed by this linkage may be straight or curved in shape, according to the shape of the block-shaped elements and the magnetic elements. The block-shaped elements may be configured to be capable of forming left-right or up-down curves when linked. It is also possible to provide not only standard block-shaped elements such as these, but also special block-shaped elements for forming intersecting tracks, diverging or converging tracks, or spiral-shaped tracks. It is also possible to provide special block-shaped elements comprising elongated magnetic elements in order to reduce the number of block-shaped elements that need to be linked. Alternatively, special blocks for causing the mobile object to jump on the track may be provided.

The magnetic element may be a magnetic plate, wherein the magnetic plate is cross-shaped. Specifically, a block-shaped element comprising this cross-shaped magnetic plate can be linked to other block-shaped elements in both the left-right direction and the front-back direction, creating an intersection at that location. If present, the abovementioned step part will exhibit the effect of keeping the magnet of the mobile object from derailing in both the left-right direction and the front-back direction.

It is possible to include a block-shaped element that comprises at least one pair of the projecting and recessed parts, at least one pair of the projecting parts, or at least one pair of the recessed parts, and does not comprise the aforementioned magnetic element. As long as the block has at least one pair, it need not have anything else, or may have an additional projecting or recessed part. This is necessary when constructing, for example, a three-dimensional track, such as example 3 described below. Linking an ordinary block-shaped element of this sort to the magnetic-element-comprising block-shaped element of the present invention will allow for a wider variety of combinations. In some cases, this "spacer" block-shaped element may also be substituted by a block-shaped element comprising a magnetic element.

A set of block-shaped elements that form the track may comprise a mobile object comprising, as the magnet, a magnetic wheel that is attracted to the magnetic plate while rolling. This forms a set comprising track blocks and the mobile object, allowing one to play by causing the car to travel around a track that has been assembled into various shapes or reassembled into other shapes. Stated in the reverse, the course may be shaped according to the manner in which one wishes the mobile object to move.

The mobile object may comprise a body modeled after a vehicle or a living creature above the magnetic wheel. While the mobile object may be simply a magnetic wheel, the mobile object may be shaped, for example, like a sports car, a panda, or a dolphin for greater appeal.

The magnetic wheel of the mobile object may be powered by a spring installed in the body. The magnetic wheel may be manually moved along the track. Alternatively, if a track including ups and downs, such as a roller coaster track, is created, the differences in elevation can be used to cause the mobile object to travel the track even when released.

However, if powered by a spring, the mobile object will be capable of moving along the track and traveling up inclines when released.

Similarly, the magnetic wheel of the mobile object may be powered by an electric motor installed in the body. In this case, the body is also provided with a primary cell, secondary cell, power switch, or the like. Using an electric motor as a power source will enable continuous operation for much longer periods than a spring would be capable of, without the need to be wound up the way a spring does.

The motor may be configured to receive electrical power from the magnetic element of the block-shaped element. For example, two magnetic elements may be provided in two rows on the surface of the block-shaped element and configured to be electrifiable, with one magnetic element constituting a positive pole and the other constituting a negative pole, and the two poles contacting a power supply brush of the traveling mobile object. Alternatively, a separate power supply line may be provided alongside the magnetic element on the surface of the block-shaped element. Regardless of whether electrified magnetic elements or power supply lines are used, the magnetic elements or power lines must connect when a plurality of block-shaped elements are linked by the projecting and recessed parts. In either case, this configuration eliminates the need for the abovementioned primary cell or secondary cell, and thus the need to replace the primary cell or recharge the secondary cell.

JP 2006-204835 A discloses a game in which a light bulb or LED is disposed within a cylindrical or otherwise shaped clear plastic case, wired to an electrification terminal attached to the outer surface, and configured to flash with current from an external conductor element, such as a rail. However, because the external rail or the like constituting the conductor element is not formed by linking a plurality of block-shaped elements, it is not possible to assemble tracks of various shapes or reassemble the track into different shapes.

The goal described above is achieved by a magnetic toy block comprising a block-shaped element comprising at least one pair of projecting and recessed parts shaped to as to be capable of being joined together and rotating around the joining direction, and comprising, on the surface of the block-shaped element, a magnetic element for attracting magnets that can be substantially continuous when a plurality of the block-shaped elements are joined by the projecting and recessed parts; wherein a mating groove facing the joining direction of the block-shaped element is formed in a wall of either the projecting part or the recessed part, and a mating projection that mates with the mating groove is formed in the other part; when joined block-shaped elements are pulled in an unlocking direction in the opposite direction from the joining direction, the mating projection latches onto a front end of the mating groove, thereby preventing disconnection; and, when joined block-shaped elements are rotated, the mating projection surmounts the side wall of the mating groove and dislodges therefrom so that the mating projection does not latch onto the front end of the mating groove, thereby enabling disconnection.

The block-shaped elements are joined by snapping a projecting part into a recessed part to mate the two parts. The block-shaped elements destabilize more and more easily the more the block-shaped elements are connected using their own weight. The block-shaped elements can be stabilized in cases such as when a flat track is constructed in contact with indoor flooring in particular, but the mated state will readily destabilize from the weight of the block-shaped elements if a three-dimensional track is constructed. This can happen not only after the three-dimensional track has been assembled, but also in the middle of assembling the track.

In the present invention, the mating projection is configured to surmount the ridge formed by the front end of the mating groove and settle in the mating groove when moving in the snap-together direction. Conversely, the mating projection is configured to latch onto the front end of the mating groove if force pulling the block-shaped elements apart is unintentionally applied. As such, the projecting part need only be snapped into the recessed part to join the block-shaped elements. To intentionally disconnect joined block-shaped elements, meanwhile, the block-shaped elements are first rotated in opposite directions to keep the mating projection from latching onto the front end of the mating groove, then pulled apart. In this way, the block-shaped elements can easily be disconnected.

As concerns the snap-together structure of the recessed part and the projecting part, it is possible to provide a projection having a circular cross section that enables rotation of the recessed part and the projecting part on one of the contacting surfaces of the recessed part and the projecting part, and a guide that engages with the projection to guide the projection in the direction in which the block-shaped elements are pulled apart on the other contacting surface. The guide may be in the form, for example, of a step that broadens outward toward the mouth of the recessed part or the projecting part. Because the projection is guided by this step, force acts between the recessed part and the projecting part in a direction in which the two retreat from each other, thus disconnecting the blocks.

This guide structure is also effective when joining blocks. The projection on one part is guided by the step on the other part, thereby naturally aligning the mating projection and the mating groove.

While the foregoing has been a description of versatile toy blocks for constructed a track whereby a more dynamic range of motion can be obtained for a toy mobile object, the inventor, in view of the recent focus upon STEAM education, whereby science (S), technology (T), engineering (E), art (A), and mathematics (M) can be employed to lay the foundations of thinking in children, hit upon the idea that it might be possible to foster programmatic thinking by having users link the blocks according to the present invention to create their own tracks.

Therefore, these toy blocks have different colors or patterns according to their functions, such as being parts for creating straight lines or parts for forming curves, and the order of the colors or patterns of the blocks on the track can be recorded as a program to allow children to create their own track plans. Alternatively, children can be provided with such plans. The track may have a start point and an end point, or may be an endless loop.

By creating a program from the order of the colors or patterns of the block-shaped elements, one's own recorded plans can be shared with others, who can receive the recorded programs and reconstruct the tracks on their own. In this way, it is possible to foster the programmatic thinking needed to create one's own tracks. As a result, even young children who have not yet learned to read and write can program based on color or pattern, and experience both fun and a sense of accomplishment by running mobile objects on their tracks.

In addition, a track comprising magnetic elements can be constructed in small tabletop spaces, which, along with the track programming and plans, makes the present invention a revolutionary educational toy.

Effect of the Invention

The present invention allows a track comprising magnetic elements to be put together from a plurality of block-shaped elements. A mobile object provided with a magnet is attracted to the magnetic elements on the track while moving over the track thus formed. In accordance with the present invention, tracks comprising magnetic elements can be linked in various shapes and re-linked in other shapes. The present invention has also succeeded in making the track itself function as a creativity-fostering educational toy.

DETAILED DESCRIPTION OF THE INVENTION

Example 1

Figure 1:
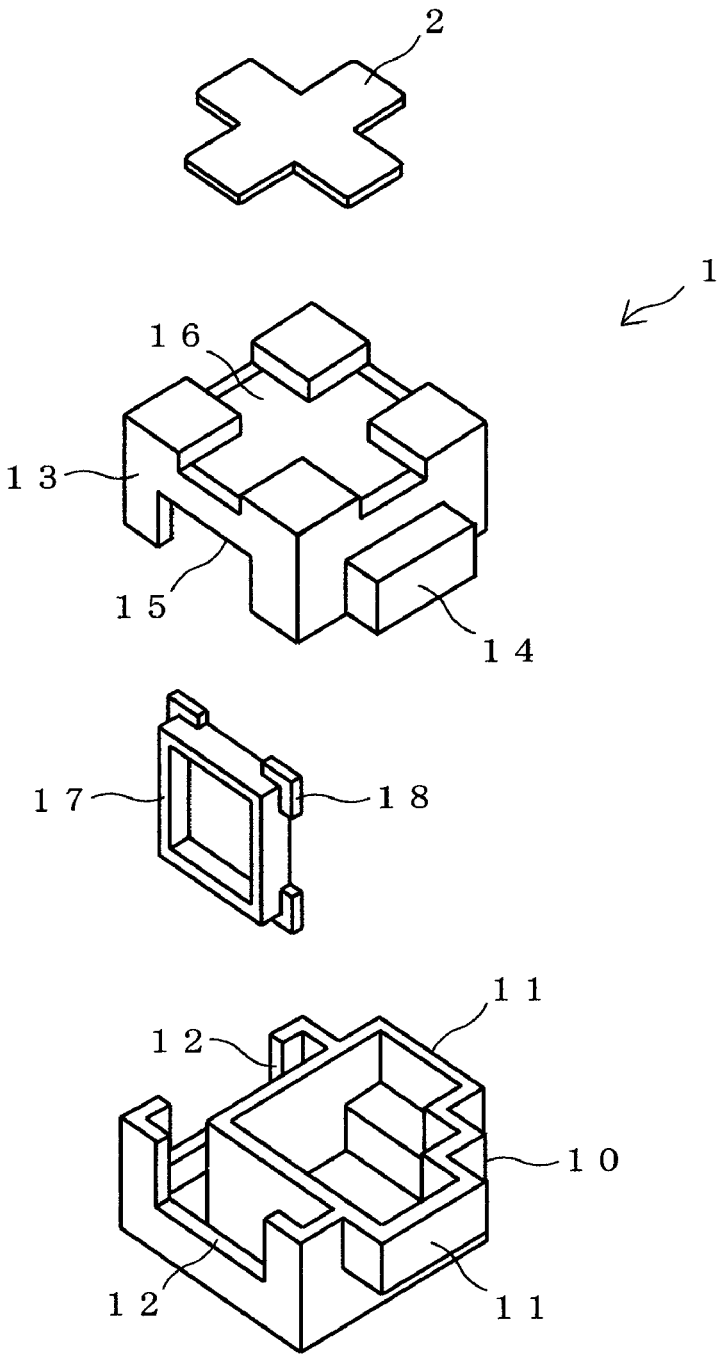
FIG. 1 is an exploded perspective illustration of a block 1 according to example 1.
Figure 2:
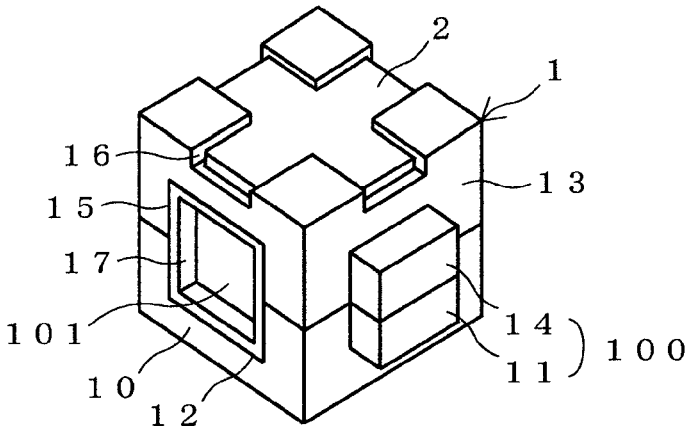
FIG. 2 is an illustration of block 1 in an assembled state.
Figure 4:
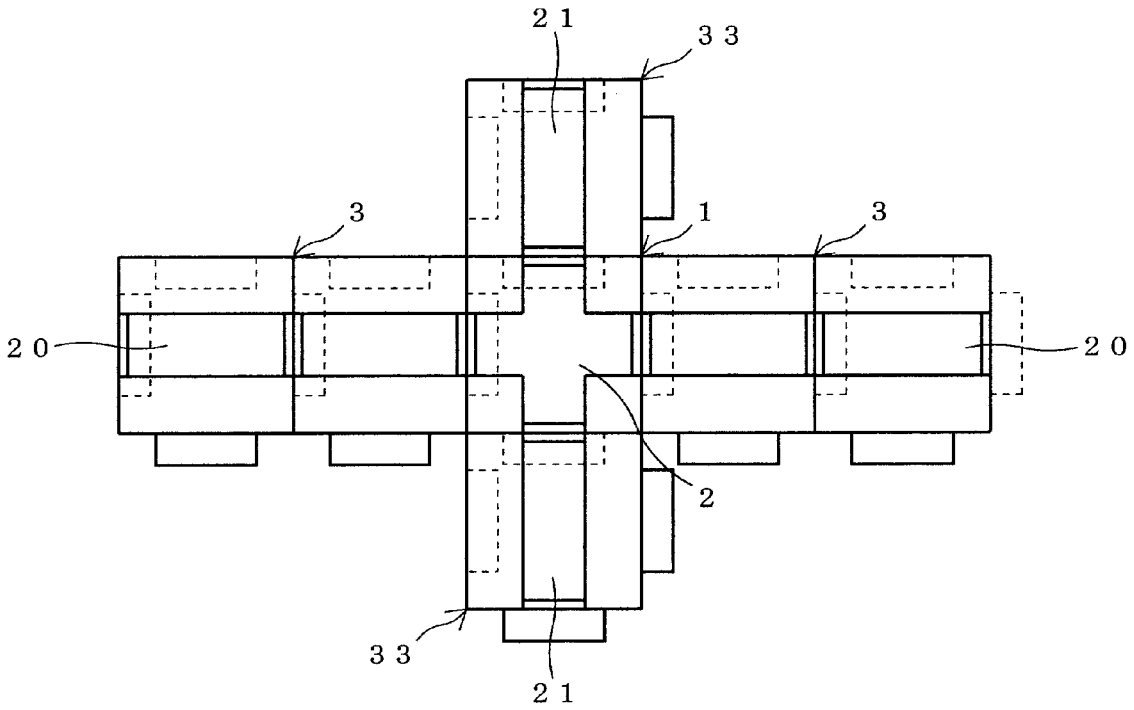
FIG. 4 is an illustration of a use state in which examples 1-3 are used.

A block 1 according to example 1 will be described with reference to FIGS. 1 and 2. This block is for creating a straight track, characterized by being capable of creating a straight track in both a lateral direction and a longitudinal direction. The block is also used to create a cross-shaped track such as shown in FIG. 4. In such cases, the block can serve as an intersection for a block 3 for a straight line in a lateral direction and a block 33 for a straight line in a longitudinal direction.

The block 1 is formed from four parts. Specifically, these are a lower half 10 and an upper half 13 each half the size of the block 1, frames 17 interposed therebetween for creating recessed parts 101 to be described below, and a magnetic plate 2 attached to the upper surface of the upper half 13.

Lower-half projecting parts 11, 11 and lower-half windows 12, 12 are provided clockwise around the four sides of the lower half 10. Upper-half projecting parts 14, 14 and upper-half windows 15, 15 are provided clockwise around the four sides of the upper half 13. The lower half 10 and the upper half 13 are combined to obtain a single block shape; at this time, the lower-half projecting parts 11 and the upper-half projecting parts 14 join at each of two locations to form projecting parts 100. The frames 17 are inserted at the locations where the lower-half windows 12 and the upper-half windows 15 join to form recessed parts 101. Latch projections 18 at the four corners of the frames 17 latch onto the insides of the lower-half windows 12 and the upper-half windows 15.

A cross-shaped groove 16 is formed in the upper surface of the upper half 13. The cross-shaped magnetic plate 2 is set in the groove 16 and bonded in place, thereby firmly anchoring the magnetic plate 2 in the groove 16. Because the depth of the groove 16 is greater than the thickness of the magnetic plate 2, the magnetic plate 2 is sunk below the surface, thereby creating step parts that enable a mobile object, such as a magnetic wheel, to resist derailment when traveling through the cross-shaped groove. The step parts are not essential because, for example, a feature such as a guard rail may also be used. Easy-to-handle sheet iron was used for the magnetic plate 2. The movement of the mobile object will be described below.

A plurality of blocks 1 thus formed from four parts is connected in the same direction to obtain a straight track not shown in the drawings. While one of the parts in this example is the frame 17 for forming the recessed part 101, a frame for forming the projecting part 100 can be separately set as a part. Moreover, while a lower half 10 and an upper half 13 are combined to obtain a single block in this example, a design is also possible in which a right half and a left half are combined to form a single block. Alternatively, synthetic resin can be insert-molded using the magnetic element as an insert to obtain an integrally molded block constituted by a single mass. In this way, the block comprising the magnetic element can have any desired design.

Example 2

A block 3 according to example 2 will be described with reference to FIG. 3(A). This is used to build a track such as shown in FIG. 4, and is one block forming the lateral straight section in FIG. 4. The configuration of block 3 substantially mimics that of block 1 from example 1 described above, with projecting parts 30, 30 and recessed parts 31, 31 being provided clockwise around the four sides thereof; however, there are slight differences in the shape of the magnetic plate 20 and the shape of the groove 32 into which the plate is set.

Specifically, the groove 32 is formed in a lateral direction, and the straight magnetic plate 20 is set and anchored in a lateral orientation. The groove 32 is designed to have a depth that is greater than the thickness of the magnetic plate 20 so that the magnetic plate 20 is sunk below the surface, thereby forming step parts that enable a magnetic wheel or other mobile object to resist derailment when traveling therethrough.

Example 3

A block 33 according to example 3 will be described with reference to FIG. 3(B). This is used to build a track such as shown in FIG. 4, and is one block forming the longitudinal straight section in FIG. 4. The configuration of block 33 substantially mimics that of block 1 from example 1 described above, with projecting parts 34, 34 and recessed parts 35, 35 being provided clockwise around the four sides thereof; however, there are slight differences in the shape of the magnetic plate 21 and the shape of the groove 36 into which the plate is set.

Specifically, the groove 36 is formed in a longitudinal direction, and the straight magnetic plate 21 is set and anchored in a longitudinal orientation. The groove 36 is designed to have a depth that is greater than the thickness of the magnetic plate 21 so that the magnetic plate 21 is sunk below the surface, thereby forming step parts that enable a magnetic wheel or other mobile object to resist derailment when traveling therethrough.

A use state in which examples 1-3 are used will be described with reference to FIG. 4. Using a plurality of blocks 3 from example 2, the projecting parts 30 can be fitted into the recessed parts 31 of adjacent blocks 3 to form a lateral straight line. Using a plurality of blocks 33 from example 3, moreover, the projecting parts 34 can be fitted into the recessed parts 35 of adjacent blocks 33 to form a longitudinal straight line. The block 1 of example 1 is used to create an intersection between these two longitudinal and lateral straight lines. The projecting parts 100 of block 1 are connectable to both the recessed parts 31 of block 3 and the recessed parts 35 of block 33, and the recessed parts 101 of block 1 are connectable to both the projecting parts 100 of block 3 and the projecting parts 34 of block 33. In this way, the positions and number of intersections can be freely altered as desired by the user.

While block 1, block 3, and block 33 are placed directly on a floor or the like and combined in the example use described above, one might also wish to stack the blocks to construct a three-dimensional track. In such cases, blocks provided in advance with recessed parts or projecting parts, according to the form of the underlying block, on the bottoms of the block as well may be used. The design of such blocks is also a matter that can be addressed as desired. The important thing is that a track be constructible using the magnetic-element-comprising blocks of the present invention.

Figure 5:
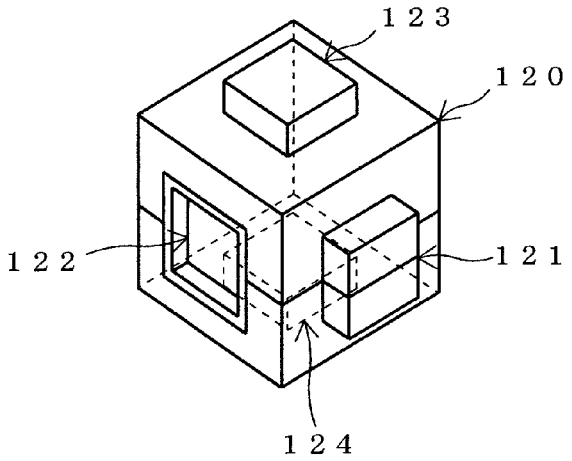
FIG. 5 is an illustration of a block not comprising a magnetic plate.

The block 120 not comprising a magnetic plate in FIG. 5 will be described as an example of the abovementioned underlying block. A projecting part 121, a recessed part 122, a recessed part 121, and a recessed part 122 are provided in clockwise order around the four sides of this block. A projecting part 123 is provided on the upper surface, and a recessed part 124 is provided in the undersurface. However, the block is a conventional "plain" block not comprising a magnetic plate.

Example 4

Figure 6:
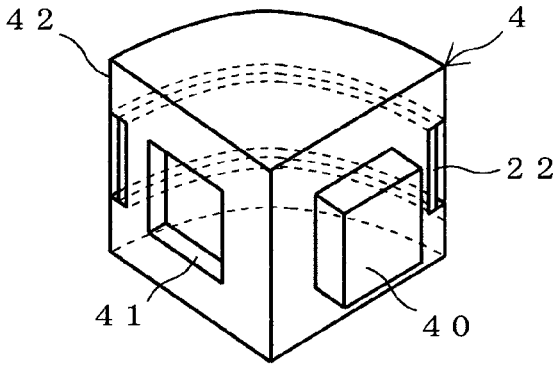
FIG. 6 is an illustration of a block 4 according to example 4.

A block 4 according to example 4 will be described with reference to FIG. 6. This block can be used to create, for example, a track that transitions downward from a horizontal track, or a track that transitions from a vertical ascending track to a horizontal track, then downward from there. It can also be combined with the block according to example 5 in FIG. 7 described below to create a track having more variation in altitude.

Block 4 comprises three faces: a side face that comprises a projecting part 40, a face orthogonal thereto that comprises a recessed part 41, and an arc-shaped face on which an outward-curving magnetic plate 22 is set in a groove 42. In other words, the block comprise one projecting part 40 and one recessed part 41 apiece. The depth of the groove 42 is greater than the thickness of the magnetic plate 22, causing the magnetic plate 22 to be sunk below the surface, and forming step parts. The block 4 may be combined, for example, with the block 1 of example 1, or with block 120, which does not comprise the magnetic plate and comprises three projecting parts 121, 121, 123 and three recessed parts 122, 122, 124, as a spacer.

Example 5

Figure 7:
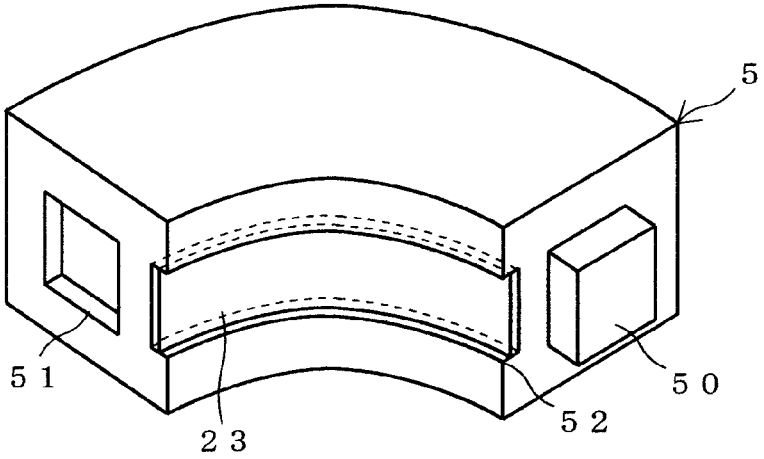
FIG. 7 is an illustration of a block 5 according to example 5.

Next, a block 5 according to example 5 will be described with reference to FIG. 7. This block comprises three faces: an arc-shaped inner side face on which an inward-curving magnetic plate 23 is set in a groove 52, the opposite of block 4 according to example 4, and two faces on which a projecting part 50 and a recessed part 51 are disposed facing orthogonal directions on either side of the side face. Because the magnetic plate 23 is set into the arc-shaped inner side face and has a tighter curvature than the arc-shaped outer side face, block 5 is designed to have a greater total length than the block 4 of example 4 described above. In addition, the depth of the groove 52 is greater than the thickness of the magnetic plate 23, causing the magnetic plate 23 to be sunk below the surface, and forming step parts.

This block 5 can be used to create, for example, a track that transitions upward from a horizontal track, or a track that transitions from a vertical descending track to a horizontal track, then upward from there.

In addition, either block 4 or block 5 can be used in the illustrated orientations, in which case a mobile object such as a magnetic wheel can be made to travel a track along the magnetic plate 22 and magnetic plate 23, i.e., the side faces.

Example 6

Figure 8:
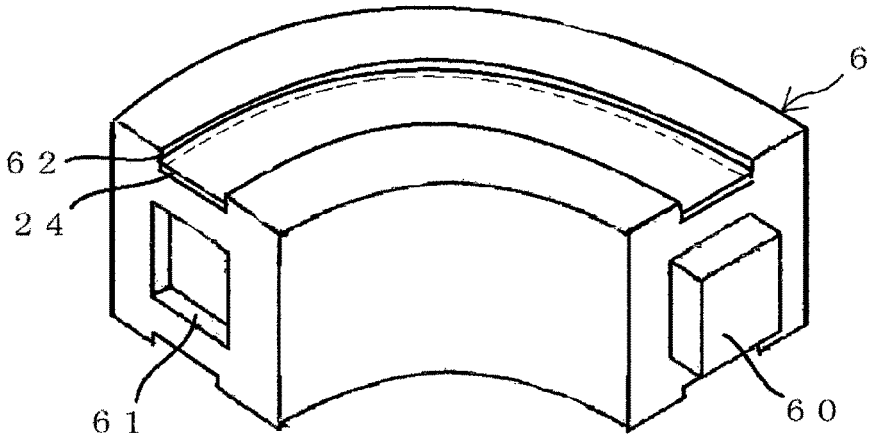
FIG. 8 is an illustration of a block 6 according to example 6.

Next, a block 6 according to example 6 will be described with reference to FIG. 8. Block 6 is a block for forming what is generally referred to as a curve. The overall shape substantially mimics that of example 5 described above, but with differences in the shape of the magnetic plate 23 and the position and shape of the groove 62 into which the plate is set.

Specifically, the groove 62 is on the upper surface of the block 6 and has a rightward-curving shape, and a rightward-curving magnetic plate 24 is set and anchored therein. As in the case of block 5 of example 5, the groove 62 is designed to have a depth that is greater than the thickness of the magnetic plate 24 so that the magnetic plate 24 is sunk below the surface, thereby forming step parts that enable a magnetic wheel or other mobile object to resist derailment when traveling therethrough.

The block may also be used with the face comprising the groove 62 facing to the side or downward, rather than the illustrated orientation. Having the face comprising the groove face downward allows the magnetic wheel or other mobile object to travel the track upside down. In practicality, it is preferable to also provide leftward-curving blocks.

Example 7

Figure 9:
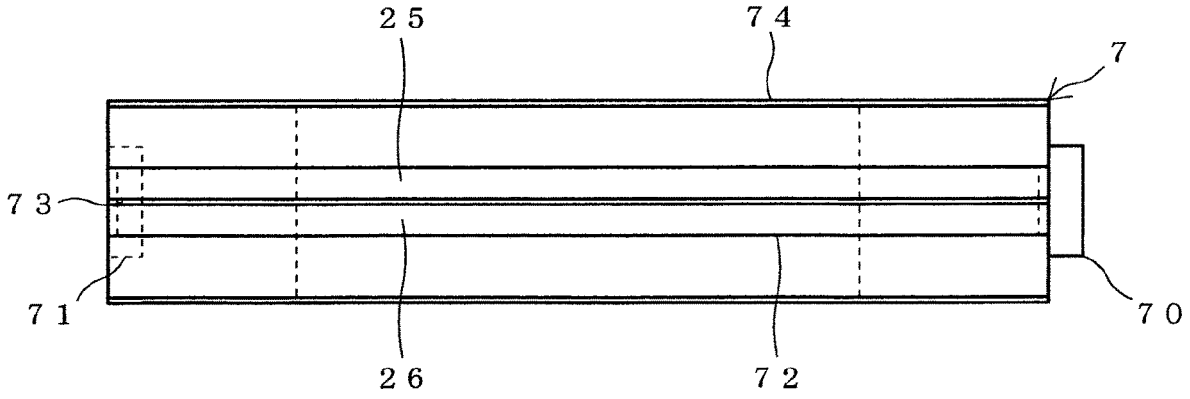
FIG. 9 is an illustration of an elongated block 7 according to example 7.

Next, an elongated block 7 according to example 7 will be described with reference to FIG. 9. This is an elongated block 7 for use when playing with an electric-motor-powered mobile object the body of which is provided with a magnetic wheel such as described above, wherein external electrical power is supplied to the electric motor. When connecting another block to this elongated block 7, the blocks must be linked so that each of magnetic plates 25, 26 described below are definitely, not just mostly, connected to magnetic plates of other blocks; the blocks may be designed accordingly The elongated block 7, which has a lateral length equivalent to five of the cubical blocks represented by dotted lines on both ends, is characterized by comprising a projecting part 70 on a side face of the head of the block, and comprising a recessed part 71 to which the projecting part 70 of another block can be mated on a side face of the tail of the block. A straight platform 72 is formed on the upper surface of the elongated block 7, with a pair of elongated magnetic plates 25, 26 being provided on the upper surface of the platform 72 with a gap therebetween, and plug-in tabs both ends of which are folded downward at right angles (not shown in the drawings) are attached so as to plug into sockets 73 provided on the ends of the platform 72. The magnetic plates 25, 26 are provided with electrifiable lead lines that lead to a power source.

The depth of the groove 72 and the thickness of the magnetic plates 25, 26 are substantially identical; in example 7, guard rails 74 are provided along both sides of the elongated block 7 so that a magnetic wheel or other mobile object can resist derailment when traveling therethrough. However, the rails need only be tall enough to create very slight step parts.

Although it is not shown in the drawings, the mobile object used in this example, in which an electric motor is used as a power source, is provided with a pair of left and right conductive brushes that contact the magnetic plates 25, 26 as the mobile object moves to receive electrical power. Using an electric motor as a power source enables perpetual continuous operation.

Figure 3:
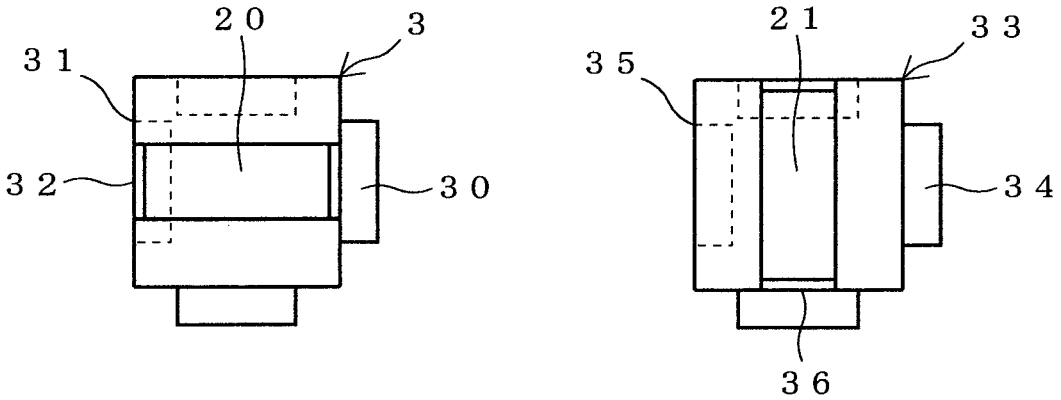
FIG. 3(A) is an illustration of an example 3.
FIG. 3(B) is an illustration of example 3.

As stated above that the elongated block 7 is five cubic blocks in length, allowing a single elongated block 7 to suffice when creating the lateral straight track shown in FIG. 4, whereas five of, for example, the blocks 3 of example 2 shown in FIG. 3(A) are necessary. In a sense, this contributes to reducing costs.

In this way, the two end blocks and one elongated track plate can be combined to obtain a new block comprising an elongated track plate. Although the elongated magnetic plate, unlike the magnetic plates of example 7, is not for supplying external electrical power to the electric motor, it may also be configured similarly.

An example of a configuration associated with the elongated block 7 will be described without reference to the drawings. This is for creating an elongated track like that of block 7 of example 7 described above; because of the configuration of the block, thinner pillars are provided rather than the cubic blocks represented by dotted lines on both ends. The projecting part 70 and recessed part 71 are formed on these pillars. This makes it possible to further reduce weight and cost.

Two examples of other configurations will be given. A straight groove is provided in the surface of a flat elongated track plate that is not block-shaped but has the length of five cubic blocks 5, and an elongated magnetic plate is bonded therein. Grooves into which anchoring projections provided on the tops of end blocks can be fit are provided on both sides of the rear face of the elongated track plate. The end blocks are cubic blocks, with projecting parts and recessed parts being provided clockwise around the four sides thereof. The abovementioned anchoring projections are on the upper parts thereof. In one example, the elongated track plate and the end blocks are configured to yield a flat surface with no step parts. In another example, the projecting part 70 and recessed part 71 of example 7 described above are formed on the upper surface of an elongated block having the length of five cubic blocks.

Example 8

Figure 10:
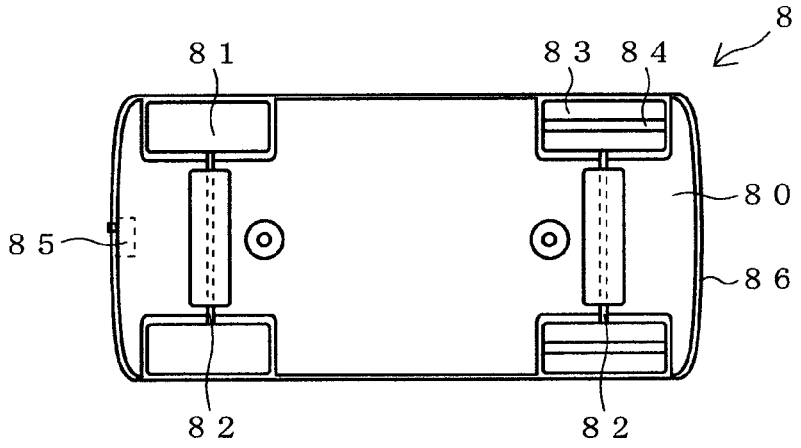
FIG. 10 is an illustration of a car 8 according to example 8.

FIG. 10 depicts a toy car 8 that can be used on various tracks, including the ones in the examples described thus far, as viewed from the side of a chassis 80 on the rear of the car.

Magnetic wheels 81 are attached to both ends of an axle 82 as front wheels of the chassis 80, and magnetic wheels 83 are attached to both ends of an axle 82 as rear wheels. Rubber O-rings 84 are fitted onto the centers of the magnetic wheels 83 constituting the rear wheels; these ensure that the wheels sufficiently grip the track. The magnetic wheels 81 and magnetic wheels 83 can be attracted to the magnetic elements such as the magnetic plate 2 and magnetic plates 20-26 described above as the car travels. A power switch 85 is provided on the front end of the chassis 80.

Although the interior of the car 8 is not shown in the drawings, the car 8 is an ordinary toy car powered by an electric motor that drives the axles 82, and is provided with a battery holder necessary for this, with the battery holder, the electric motor, and the power switch 85 being wired in series. When the power switch 85 is switched to on, the magnetic wheels 83 start to turn, and roll over the track formed by the blocks. The car is capable of traveling along the track without derailing, with the magnetic wheels 83 and magnetic wheels 81 being attracted to the magnetic elements of the blocks.

A body 86 is attached to the top of the chassis 80. The body 86 is shaped like an ordinary car, but may also be shaped like an animal or the like.

Example 9

Figure 11:
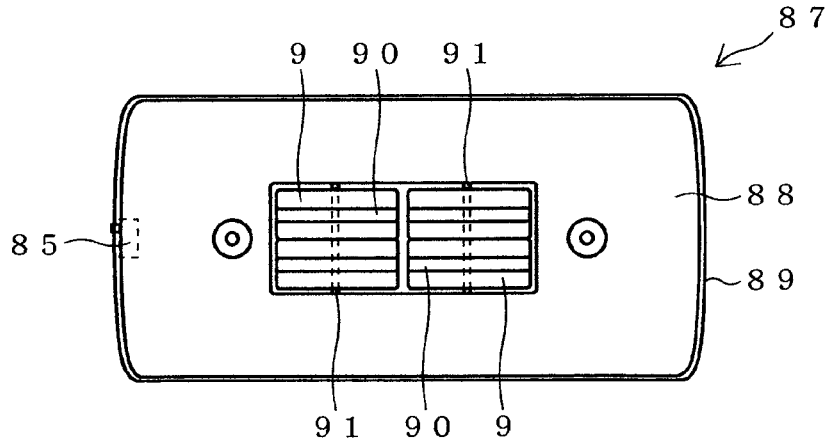
FIG. 11 is an illustration of a car 87 according to example 9.

Next, a car 87 according to this example will be described with reference to FIG. 11. This car is provided with two sets of front and rear magnetic wheels 9, each set comprising one pair of left and right wheels, in the center of the chassis 88. Rubber O-rings 90 are fitted onto the centers of the magnetic wheels 9; these ensure that the wheels sufficiently grip the track. The magnetic wheels 9 are attached to axles 91 provided on the chassis 88. A car-shaped body 89 is attached to the top of the chassis 88. The internal configuration of the car 87 mimics that of example 8 described above.

The car 87 of this example is capable of traveling along the track without derailing, with the magnetic wheels 9 in the center of the chassis 88 being attracted to the magnetic elements of the blocks.

Example 10

Figure 12:
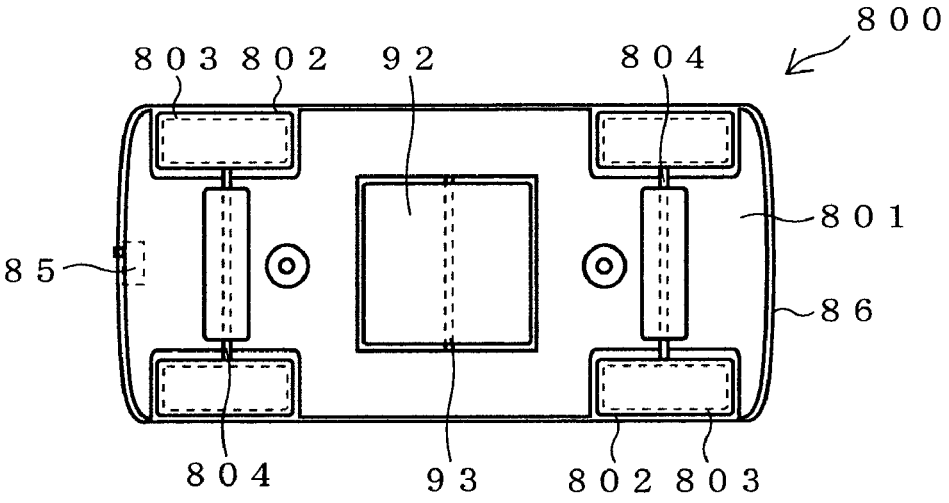
FIG. 12 is an illustration of a car 800 according to example 10.
Figure 13:
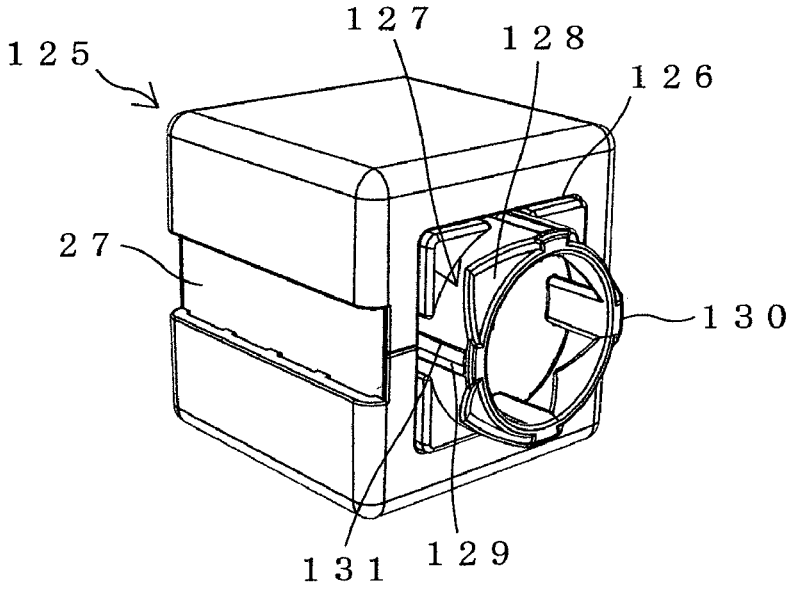
FIG. 13 is an illustration of a projecting member 127 of a block 125 according to example 11.
Figure 14:
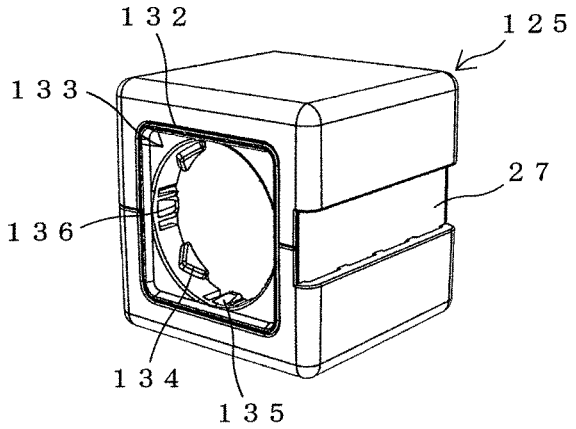
FIG. 14 is an illustration of a recessed member 133 of block 125 according to example 11.
Figure 15:
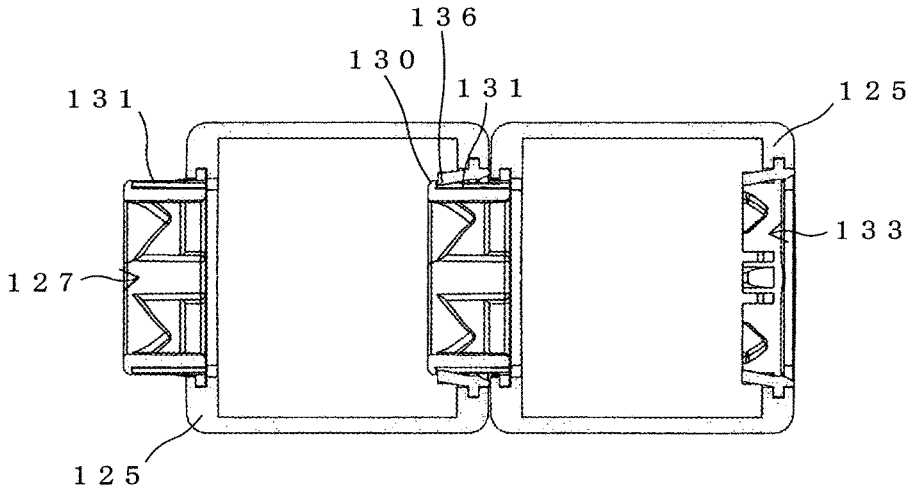
FIG. 15 is an illustration of blocks 125 being joined.
Figure 16:
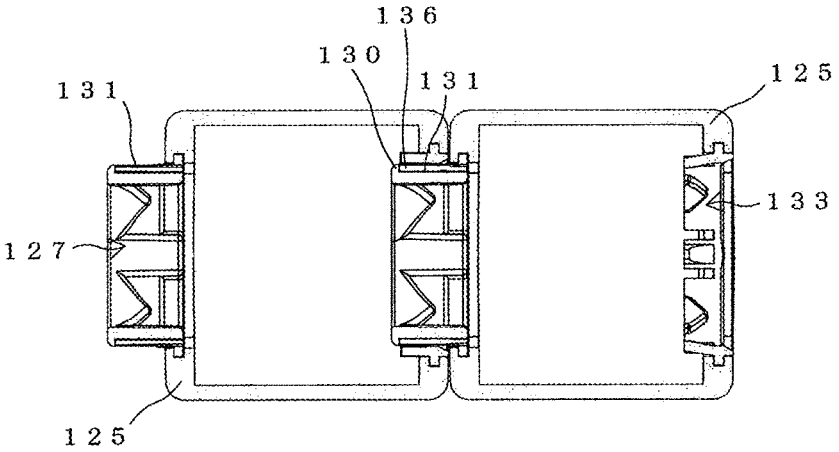
FIG. 16 is an illustration of blocks 125 being disconnected.

Next, a car 800 according to example 10 will be described with reference to FIG. 12. Synthetic resin wheels 802 are attached to both ends of axles 804 as front and rear wheels of the chassis 801, with magnets 803 indicated by dotted lines being set inside the wheels. In a sense, the magnets 803 are covered by the wheels 802, and are characterized by being attracted to the magnetic elements despite not touching them as the car travels.

The internal configuration of the car 800 mimics that of example 8 described above; however, power for this car 800 is transmitted to a magnetic wheel 92 provided in the center of the chassis 801. An axle 93 allows the magnetic wheel 92 to freely rotate. Reference number 85 indicates a power switch.

Example 11

A block 125 according to example 11 will now be described with reference to FIGS. 13-16. In example 1 described above, for example, the blocks 1 are joined by mating projecting parts 100 and recessed parts 101. While this arrangement is acceptable as far as it goes, the blocks could also be viewed as simply having been mated by being snapped together. Specifically, while the track will be stable if built on a flat location such as interior flooring, the weight of the blocks 1 could cause the projecting parts 100 and the recessed parts 101 to disconnect if a three-dimensional track is built. This can happen not only after the three-dimensional track has been built, but also in the middle of building the track. If this would be unacceptable, one could, for example, provide ridges on the projecting parts 100 and the recessed parts 101 to provide a sensation of locking into place, but a more thorough solution is desirable. Specifically, the next goal is to provide a block that has sufficient tensile strength and can easily be disconnected, as necessary.

To that end, example 11 comprises a magnetic plate 27 that is oriented in the same direction as the top surface and the bottom surface of the cubical block 125, with a cylindrical projecting member 127 being attached to a window 126 provided in the surface of one side in this direction, and a recessed member 133 being attached to a window 132 provided on the surface on the other side. Mating grooves 129 are formed at two rotationally symmetric positions on the outer wall of the projecting member 127 so as to leave end-reaching parts toward the opening of the cylinder. As such, the end-reaching parts form stoppers 130 to be described below, and steps 131 to be described below are formed on both sides of the mating grooves 129.

Meanwhile, resilient mating tabs 135 are formed at four rotationally symmetric positions on the inner wall of the recessed member 133—specifically, at locations that engage with the mating grooves 129, and mating projections 136 that project toward the mating grooves 129 are formed in the distal ends of the mating tabs 135. As such, to join two blocks 12 together, the positions of the mating tabs 135 and the mating grooves 129 are lined up, and the projecting member 127 is inserted into the recessed member 133. The mating projections 136 can utilize the resilience of the mating tabs 135 to surmount the stoppers 130 during the insertion process, but are configured so that the mating projections 136 catch upon the stoppers 130 and prevented from surmounting the stoppers 130 when, conversely, pulling force is applied to the blocks 125 to disconnect the blocks, or unintentionally applied.

The mating projections 136 are configured to be capable of surmounting those steps 131 to the sides of the mating grooves 129 that are in the twisting direction when the blocks are twisted to intentionally disconnect the blocks; as a result, the mating projections 136 bypass the stoppers 130 to disengage with the mating grooves 129, thereby disconnecting the blocks 125. The projecting member 127 and the recessed member 133 are both cylindrical in shape, and thus permit twisting.

Different structures are provided on the inner wall of the recessed member 133 and the outer wall of the projecting member 127. Specifically, projecting guides 134 with triangular apexes that project toward the opening of the cylinder are provided at four rotationally symmetric positions between the mating tabs 135 on the inner wall of the recessed member 133. Meanwhile, guide grooves 128 into which the projecting guides 134 can fit with some play therebetween are provided at four rotationally symmetric positions between the mating grooves 129 on the outer wall of the projecting member 127.

To intentionally disconnect the blocks 125, the blocks are twisted to cause the mating projections 136 to surmount the steps 131, as described above; it is at this time that the projecting guides 134 contact the guide grooves 128, which spread outward toward the opening of the projecting member 127, and are guided from there by the guide grooves 128 so that force acts in a direction such that the blocks 125 retreat from each other, thereby disconnecting the blocks. The structures of the guide grooves 128 and the projecting guides 134 are also effective when joining blocks 125. Specifically, the projecting guides 134 are guided by the guide grooves 128 during this process as well, thereby naturally aligning the mating grooves 129 and the mating tabs 135 and eliminating the need to devote attention thereto.

Example 12

Figure 17:
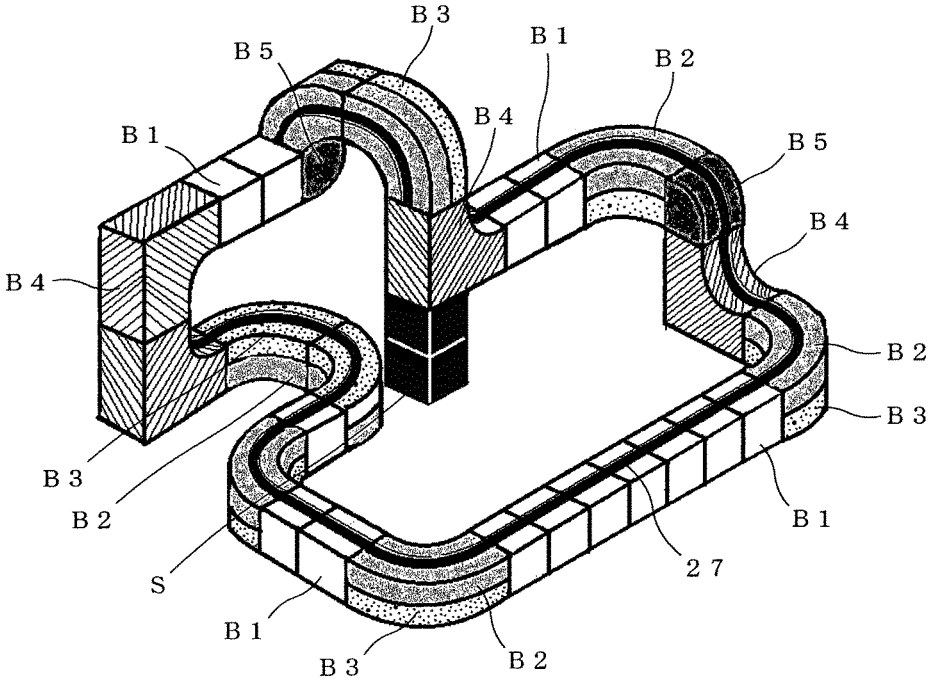
FIG. 17 is an illustration of a programmed three-dimensional track according to example 12.

Next, a programmed three-dimensional track according to example 12 will be described with reference to FIG. 17. A looping track has been constructed using blocks B1-B5 having different shapes and roles, and spacer S blocks. For convenience, "block B2" and "block B3" refer to front and rear sides of the same block. The blocks B1-B5 are color-coded, with block B1 being yellow, block B2 on the front side of one block is blue, block B3 on the rear side of the same block is green, block B4 is orange, and block B5 is red. The blocks S, which do not comprise magnetic plates 27, are spacers for lifting block B4 from the surface of a table.

Going counterclockwise from the right side of the yellow block B1 at the second from the right end, on which the projecting member 127 of said block B1 is present, the order of the blocks is yellow (B1), blue B2 (green B3 on rear side), orange (B4), red (B5), blue B2, 2×yellow (B1), orange (B4), an arch-shaped green B3 (blue B2 facing front), red (B5), 2×yellow (B1), 2×orange (B4), 2×green B3, yellow (B1), blue B2, 2×yellow (B1), blue B2, and 6×yellow (B1), then connecting with the recessed member 133 of the block B1 at the starting point. A magnetic vehicle can repeatedly travel over the magnetic plates 27 on the loop track thus constructed.

While the linkage of blocks in the counterclockwise direction starting from the yellow block B1 at the starting point has been expressed in writing as above, it is also possible to record only the colors of the blocks. In other words, one may record yellow-blue-orange-red-blue-yellow-yellow-orange-green-green-red-yellow-yellow-orange-orange-green-green-yellow-blue-yellow-yellow-blue-yellow- yellow-yellow-yellow-yellow-yellow (going counterclockwise). The colors can be displayed in writing in this way, or, in the case of young children who haven't yet learned to read, displayed simply as colors using colored pencils or the like, or, for example, by putting colored stickers on a sheet. This is the "programming" referred to in the present invention.

This track programming can also be performed by envisioning the track in one's mind before combining the blocks. One can also refer to a program for a previously assembled track to assemble the same track by oneself. This example of the present invention, in which programming can be performed by color in this way, is an educational toy for STEAM education for laying the foundations of thinking in children, and advantageously enables users, from young children to adults, to play together. Apart from color, the block elements can also be expressed using patterns, block silhouette, or the like; this is a design matter that may be addressed as desired.

The present invention is not limited to the examples described above, and may be modified in any way within the concept of the invention, i.e., a toy block in which a magnetic element is provided on a block-shaped element comprising projecting and recessed parts shaped so as to be capable of being joined together. For example, the shape of the blocks may be triangular prisms or cylinders. The elongated elements illustrated in FIG. 9 and thereafter can be used to form slopes, various kinds of spirals, jump ramps, and see-saws. Alternatively, a switch for switching the track of the mobile object in the same manner as model train tracks may be provided. It is also preferable to prepare accessory blocks for blocking the step parts or recessed parts of the blocks, and stabilizing grounding on the floor. These accessory blocks may, for example, be molded from slip-resistant synthetic rubber.

The blocks themselves may be made to serve as magnetic elements by forming the blocks from sheet iron to create blocks similar to tin toys. This would fall within the scope of comprising a magnetic element. The track portion may be set above the magnetic element by drawing tracks on the sheet iron blocks. In other words, the feature of forming the blocks from sheet iron to make the blocks themselves serve as magnetic elements is also within the scope of the present invention.

The mobile object comprising magnetic wheels need not necessarily have a power source, but can also be played with by manually pushing the mobile object to create momentum. While a toy car 8 powered by an electric motor was described in example 8, a car powered by a spring not shown in the drawings rather than an electric motor may be designed. If a spring is used, not only a key to wind up the spring, but also a switch to turn the object on and off, should be provided.

INDUSTRIAL APPLICABILITY

Using the toy block of the present invention, a track comprising magnetic plates can be connected in various shapes, or reconnected in different shapes. In this way, the track itself is also made to function as a creativity-fostering educational toy, thereby greatly contributing to industrial development. The blocks may be made of any material, such as synthetic resin; wood can be used to impart the superior properties of wooden toys such as building blocks, and also provide a route for making effective use of thinned timber.

DESCRIPTION OF THE REFERENCE NUMBERS

1, 120, 125, 3, 33, 4, 5, 6, B1-B5 Block
7 Elongated block

10 Lower half
11 Lower half projecting part
12 Lower-half window
13 Upper half
14 Upper-half projecting part
15 Upper-half window
16, 32, 36, 42, 52, 62 Groove
17 Frame
18 Latch projection
100, 121, 123, 30, 34, 40, 50, 60, 70 Projecting part
101, 122, 124, 31, 35, 41, 51, 61, 71 Recessed part
126, 132 Window
127 Projecting member
128 Guide groove
129 Mating groove
130 Stopper
131 Step
133 Recessed member
134 Projecting guide
135 Mating tab
136 Mating projection
2, 20-26, 27 Magnetic plate
72 Platform
73 Socket
74 Guide rail
8, 87, 800 Car
80, 88, 801 Chassis
81, 83, 9, 92 Magnetic wheel
82, 804, 91, 93 Rotary shaft
84, 90 O-ring
85 Power switch
86, 89 Body
802 Wheel
803 Magnet
S Spacer

The invention claimed is:

1. A magnetic block toy having a plurality of block-shaped elements, wherein a block-shaped element comprises at least one pair of projecting and recessed parts shaped so that a plurality of block-shaped elements are joinable and rotatable around a joining direction defined as a direction to join a block-shaped element to another block-shaped element, wherein the projecting part is provided on at least one surface of the block-shaped element and the recessed part is provided on a surface opposite to the at least one surface, a magnetic element for attracting to a magnet is provided on a surface of the block-shaped element on which the projecting and recessed parts are not provided, and when a plurality of the block-shaped elements are joined together by the projecting and recessed parts a plurality of the magnetic elements become continuous, wherein the projecting part comprises an outer peripheral wall, and the recessed part comprises an inner peripheral wall that faces the projecting part of another block-shaped element when a pair of the block-shaped elements is joined, wherein a mating groove extending along the joining direction of the block-shaped elements is formed in the outer peripheral wall of the projecting part, and a mating projection that mates with the mating groove is formed on the inner peripheral wall of the recessed part, and the mating groove and the mating projection are configured such that when a pair of the block-shaped elements are pressed toward the joining direction, they are joined by the mating projection surmounting a front end of the mating groove that is formed as a ridge, when the joined block-shaped elements are pulled in an unlocking direction in an opposite direction from the joining direction, the mating projection latches onto the front end of the mating groove thereby preventing disconnection, and when the joined block-shaped elements are rotated, the mating projection is dislodged from the mating groove and runs onto the outer peripheral wall of the projecting part while being guided diagonally in a direction of release by an engagement of a protruded guide that is provided on the inner peripheral wall of the recessed part with a triangular apex facing to the joining direction of the block-shaped elements and a groove-shaped guide provided on the outer peripheral wall of the protruding part that fits with some play into the protruding guide, thereby enabling disconnection by preventing the mating projection from latching onto the front end of the mating groove.

2. The magnetic block toy-according to claim 1, wherein the magnetic element is a magnetic plate, a groove for accommodating the magnetic plate is formed in the surface of the block-shaped element from one edge to another edge of the surface, the magnetic plate is present in the groove, and a step part that serves as a guide rail for the magnet is formed to the outside of the magnetic plate.

3. The magnetic block toy according to claim 1, wherein the magnetic element is a magnetic plate, a platform that also serves as a guide rail for the magnet is formed on the surface of the block-shaped element from one edge to another edge of the surface, and the magnetic plate is present on the platform.

4. The magnetic block toy according to claim 1, wherein the magnetic element is a magnetic plate that has a straight or curved shape.

5. The magnetic block toy according to claim 1, wherein the magnetic element is a magnetic plate that is cross-shaped.

6. The magnetic block toy according to claim 1, further including an additional block-shaped element without a magnetic element, wherein the additional block-shaped element comprises at least one pair of the projecting and recessed parts, at least one pair of the projecting parts, or at least one pair of the recessed parts.

7. The magnetic block toy according to claim 1, provided with a mobile object comprising, as the magnet, a magnetic wheel that is attracted to the magnetic element while rolling.

8. The magnetic block toy according to claim 7, comprising a body modeled after a vehicle or living creature above the magnetic toy block.

9. The magnetic block toy according to claim 7, wherein the magnetic wheel is powered by a spring installed in the body.

10. The magnetic block toy according to claim 7, wherein the magnetic wheel is powered by an electric motor installed in the body.

11. The magnetic block toy according to claim 10, wherein the motor is configured to receive electrical power from the magnetic element of the block-shaped element.

12. The magnetic block toy according to claim 1, wherein the block-shaped elements have different colors or patterns according to their shapes.

* * * * *